US008142712B2

(12) United States Patent
Ko et al.

(10) Patent No.: US 8,142,712 B2
(45) Date of Patent: Mar. 27, 2012

(54) HEATING FURNACE FOR PRESS HARDENING PROCESS

(75) Inventors: Kanghee Ko, Seoul (KR); Chisang Yoon, Chungcheong (KR); Soonyong Kwon, Goyang-si (KR)

(73) Assignee: Hyundai Steel Company, Incheon (KR)

( * ) Notice: Subject to any disclaimer, the term of this patent is extended or adjusted under 35 U.S.C. 154(b) by 0 days.

(21) Appl. No.: 12/955,868

(22) Filed: Nov. 29, 2010

(65) Prior Publication Data

US 2011/0068518 A1 Mar. 24, 2011

Related U.S. Application Data

(63) Continuation of application No. PCT/KR2009/004192, filed on Jul. 28, 2009.

(30) Foreign Application Priority Data

Aug. 28, 2008 (KR) ..... 10-2008-0084668

(51) Int. Cl.
*C21D 9/00* (2006.01)

(52) U.S. Cl. ..... 266/249; 266/78; 269/43

(58) Field of Classification Search ..... 266/78, 266/99, 131, 130, 100, 132, 249; 269/32, 269/43, 45, 289 MR; 198/468.2, 468.3
See application file for complete search history.

(56) References Cited

U.S. PATENT DOCUMENTS

| | | | | |
|---|---|---|---|---|
| 793,268 | A * | 6/1905 | Bates | 266/252 |
| 2,271,091 | A | 1/1942 | Pecker et al. | |
| 3,245,131 | A | 4/1966 | Kimble | |
| 4,786,249 | A * | 11/1988 | Kaji | 432/121 |
| 6,174,390 | B1 | 1/2001 | Baba et al. | |
| 6,905,332 | B1 * | 6/2005 | Neal et al. | 432/247 |
| 7,137,201 | B2 * | 11/2006 | Brodt et al. | 29/897.2 |
| 7,422,650 | B2 * | 9/2008 | McGlinchy | 156/275.5 |
| 2007/0175040 | A1 * | 8/2007 | Bayer et al. | 29/897.2 |

FOREIGN PATENT DOCUMENTS

| | | | |
|---|---|---|---|
| GB | 1112792 | | 5/1968 |
| JP | 61-287222 | A | 12/1986 |
| JP | 07-324872 | * | 12/1995 |

(Continued)

OTHER PUBLICATIONS

Search Report dated May 16, 2011 in corresponding EP Application No. 09 810 136.3-5 pages.

International Search Report and Written Opinion dated Mar. 18, 2010 of corresponding PCT Application No. PCT/KR2009/004192 filed Jul. 28, 2009—6 pages.

(Continued)

*Primary Examiner* — Scott Kastler
*Assistant Examiner* — Michael Aboagye
(74) *Attorney, Agent, or Firm* — Knobbe Martens Olson & Bear LLP

(57) ABSTRACT

A heating furnace according to an embodiment of the present invention includes: a furnace body that has an inlet at the upper portion through which a steel sheet blank is inserted from a wound coil and an outlet at the lower portion through which the steel sheet blank is discharged, and has a cylindrical structure having a space for conveying the steel sheet blank; a conveyer that is spirally disposed on the inner circumference of the furnace body and sequentially conveys the steel sheet blank from the inlet at the upper portion and the outlet at the lower portion; and a clamping means that is disposed at one side of the conveyer and selectively clamps the steel sheet blank.

15 Claims, 9 Drawing Sheets

FOREIGN PATENT DOCUMENTS

| | | | |
|---|---|---|---|
| JP | 07-324872 | A | 12/1995 |
| JP | 3066147 | U | 11/1999 |
| KR | 20-1984-000145 | Y1 | 2/1984 |
| WO | 02/50484 | A1 | 6/2002 |

OTHER PUBLICATIONS

Office Action dated Dec. 16, 2011 in the Counterpart Korean application, Korean Patent Application No. 10-2009-0068741, in 4 pages.

* cited by examiner

HEATING FURNACE FOR PRESS HARDENING PROCESS

TECHNICAL FIELD

The present invention relates to a heating furnace for press hardening process, and more particularly, to a heating furnace for press hardening process that makes it possible to decrease the length of straight furnaces of the related art and reduce heat loss and fuel consumption, by applying a spiral structure to a furnace that heats a steel sheet for press hardening at 900° C. or more in press hardening.

BACKGROUND ART

In general, a method of manufacturing a high-strength press-hardened product includes heating a steel material of which hardenability is improved by adding B, Mo, and Cr etc. at a high temperature of about 900° C. above an Ac3 transformation point to be completely changed into an austenite state, hot-forming the steel sheet at one time into a product shape with a press die, and rapidly cooling it into a martensite structure.

As well known in the related art, a steel sheet is easy to form because its ductility is increased when being heated at a high temperature. Thus, the machinability of a steel sheet manufactured by press hardening is slightly better than that of typical steel sheets for machining and considerably better than that of high-strength steel.

Further, a steel sheet manufactured by press hardening has very high strength (above 1,400 MPa) such that it is significantly advantageous in terms of specific strength, obtained by dividing yield strength by density, and thus can considerably contribute to reducing weight of vehicles. Further, the steel sheet manufactured by press hardening is used to manufacture ultra high-strength parts that are difficult to form, because there is little spring back after machining.

It is required to heat a steel sheet at about 900° C. or more for several minutes to transform the steel sheet to an austenite state in press hardening process, and this should be automated for an efficient process.

As shown in FIG. 1, a blank B is heated in a heating furnace for press hardening process of the related art for several minutes. The blank B to be hardened is obtained from a wound steel sheet coil C and, heated through a straight furnace O for achieving an automated process, carried by a robot R to a press P, and then pressed therein.

However, the straight furnace system includes a several tens of meters straight unit to maintain a predetermined temperature for a predetermined time so as to achieve complete austenite transformation. Thus, efficiency for heating to desired temperature is low, and a large factory area is required to install the equipment.

Further, in the existing straight furnace system, since the steel sheet blank is conveyed on a conveying unit such as a roller table, a temperature difference occurs between the upper portion and the portion contacting the conveying unit. Thus, the quality of a product made of such steel sheet is deteriorated.

DISCLOSURE

Technical Problem

In order to solve the above problems, the present invention has been made in an effort to provide a heating furnace for press hardening process that makes it possible to significantly decrease an area and a length for furnace equipment and increase the available area in a factor, by applying an improved spiral structure to the furnace that heats a steel sheet for press hardening.

Further, the present invention has been made in an effort to provide a heating furnace for press hardening process that uniformly heats a steel sheet passing through the furnace, without generating a temperature difference in the steel sheet.

Technical Solution

In order to achieve the objects, an embodiment of the present invention provides a heating furnace for press hardening process, which includes: a conveyer that has a spiral shaped configuration, is disposed inside the furnace body, and is configured to circulate by track circulation; and a clamping means that is attached to one side of the conveyer and selectively clamps and conveys a steel sheet blank.

The clamping means includes: a fixed block fixed to one side of the conveyer; and a movable block spaced apart from the fixed block to correspond to the fixed block and moved forward/backward to clamp the steel sheet blank by a moving means.

The moving means includes: a fixed rail that protrudes upward from one side of the conveyer, wherein the movable block is slidably seated on the fixed rail; and an actuator that is connected to one side of the movable block seated on the fixed rail and moves the movable block by moving the rod forward in response to an external signal.

The actuator may comprise a pneumatic cylinder or a motor that moves the rod forward/backward in response to an external electric signal.

The heating furnace further includes guide members that are disposed at one side of the conveyer and guide the steel sheet blank to the clamping means.

The heating furnace further includes a heat-accumulating member that is disposed close to the conveyer and accumulates heat transmitted through the fire holes.

The heating furnace further includes a discharging means that is disposed at the outlet of the furnace body and supplies the steel sheet blank discharged out of the furnace body to a press, while shielding the steel sheet blank from external air.

The discharging unit includes: a frame having one end connected to the outlet of the furnace body and the other end equipped with a door; and a discharging conveyer that is disposed inside the frame and conveys the steel sheet blank transported from the conveyer, to the press.

The discharging conveyer includes: a transporting conveyer part that is disposed close to the outlet of the furnace body and horizontally conveys the steel sheet blank; and an inclined conveyer part that is connected with the transporting conveyer part and conveys the steel sheet blank to an insertion height of the press.

Another embodiment of the present invention provides a heating furnace for press hardening process, which includes: a furnace body having a plurality of fire holes therein and an inlet and an outlet at the upper portion and the lower portion, respectively; a conveyer that has a spiral shaped configuration, is disposed inside the furnace body, and is configured to circulate by track circulation; a clamping means that is attached to one side of the conveyer and clamps and conveys the steel sheet blank; an inserting means that is disposed close to the inlet of the furnace body and has a plurality of rotatable conveying rollers to convey the steel sheet blank to the clamping means; and a discharging means that is disposed close to the outlet of the furnace body and supplies the steel sheet blank discharged out of the furnace body to the press while shielding the steel sheet blank from external air.

Yet another embodiment of the present invention provides a heating furnace for press hardening process, which includes: a furnace body that has an inlet and an outlet; a conveyer device that has a spiral shaped configuration, is disposed inside the furnace body, and is configured to circulate by track circulation, and have inner and outer lines; and a clamping means that is attached to one side of the conveyer and clamps and conveys a steel sheet blank.

The conveyer device has an inner conveyer and an outer conveyer that circulate in opposite directions.

The heating furnace further includes: a position sensor that senses whether the clamping means of the inner conveyer and the outer conveyer are aligned and outputs an electric signal; and a controller that outputs a control signal for conveying the steel sheet blank to the clamping means, after determining that the clamping means of the inner conveyer and the outer conveyer are aligned on the basis of a signal outputted from the position sensor.

The heating furnace further includes a discharging means that is disposed at the outlet of the furnace body and supplies the steel sheet blank discharged out of the furnace body to a press, while shielding the steel sheet blank from the external air, in which the discharging unit includes: a frame having one end connected to the outlet of the furnace body and the other end equipped with a door at the upper portion; and a discharging conveyer that is disposed inside the frame and conveys the steel sheet blank transported from the conveyer to the door, maintaining the steel sheet blank upright by using the clamping means; and a robot that holds the steel sheet blank conveyed from the discharging conveyer and supplies the steel sheet blank to the press.

Advantageous Effects

The present invention improves the structure of a furnace that heat a steel sheet blank before press hardening such that the steel sheet blank is spirally conveyed down. Therefore, according to the embodiments of the present invention, it is possible to increase an available space in a factory by reducing the length and space occupied by equipment, as compared with straight furnace system. Further, since the steel sheet blank is uniformly heated throughout the entire portion while conveying, the structure uniformly transforms, thereby improving quality of a product.

Further, the heated area of the steel sheet blank that is conveyed increases, such that the heating time is reduced and the productivity is improved.

BEST MODE

Figure 1:
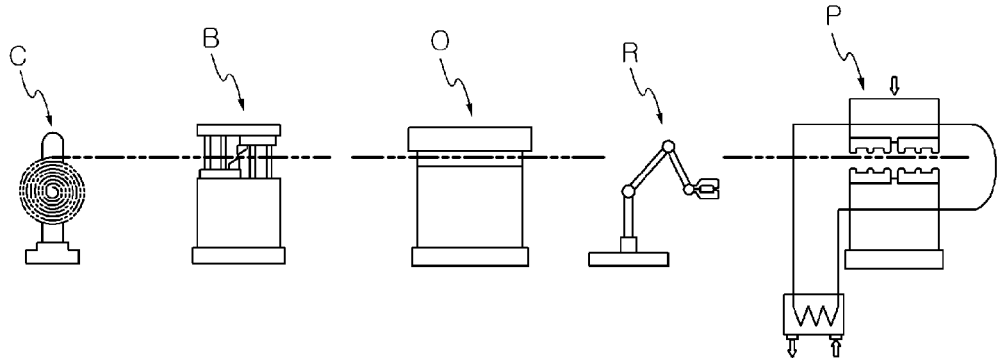
FIG. 1 Prior Art
FIG. 1 is a view schematically showing press hardening of the related art.
Figure 2:
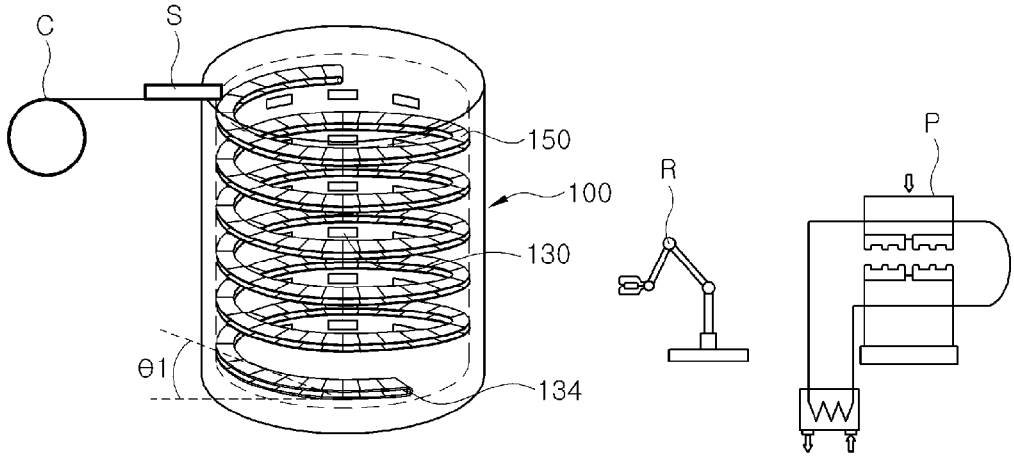
FIG. 2 is a view showing the configuration of a first embodiment of a heating furnace for press hardening process according to the present invention.
Figure 3:
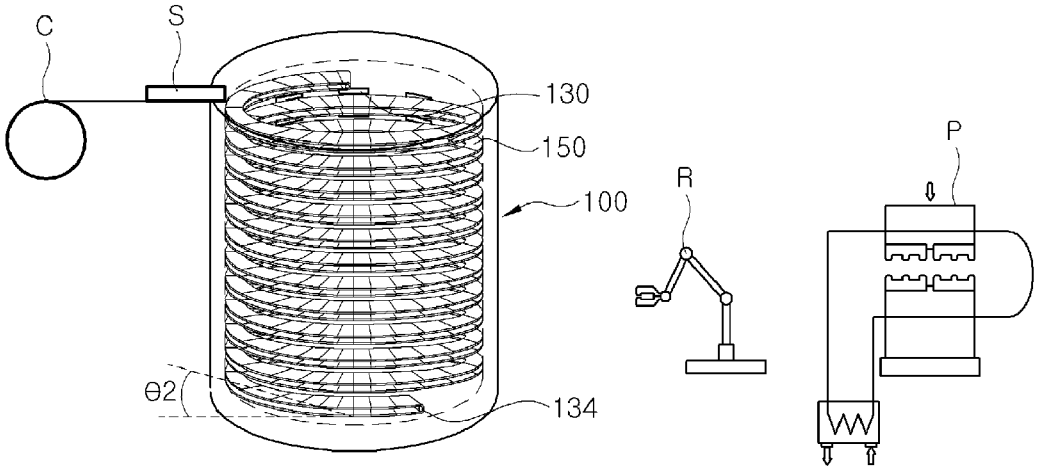
FIG. 3 is a view showing another embodiment of a conveyer of the present invention which is arranged at a different angle with respect to the inner circumference of a furnace body.
Figure 4:
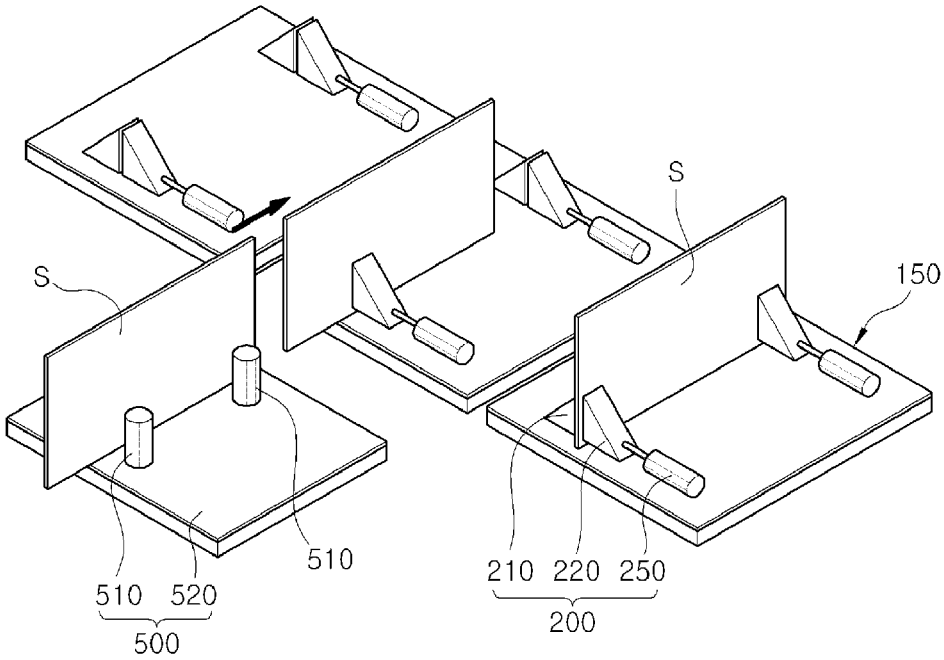
FIG. 4 is a view showing when a steel sheet blank is clamped to the conveyer of the present invention through an inserting means.
Figure 5:
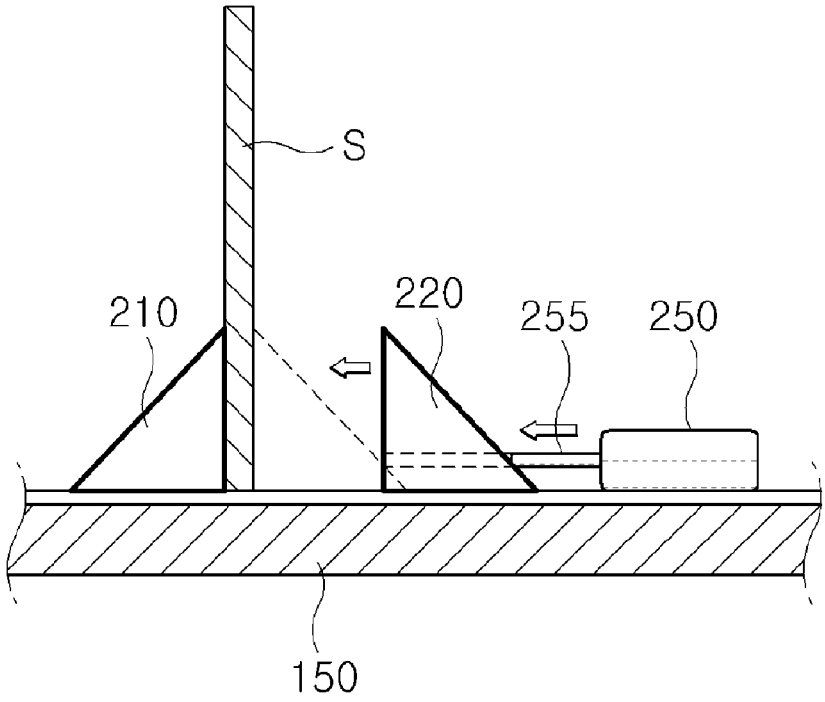
FIG. 5 is a view showing the operation of FIG. 4, seen from a side.
Figure 6:
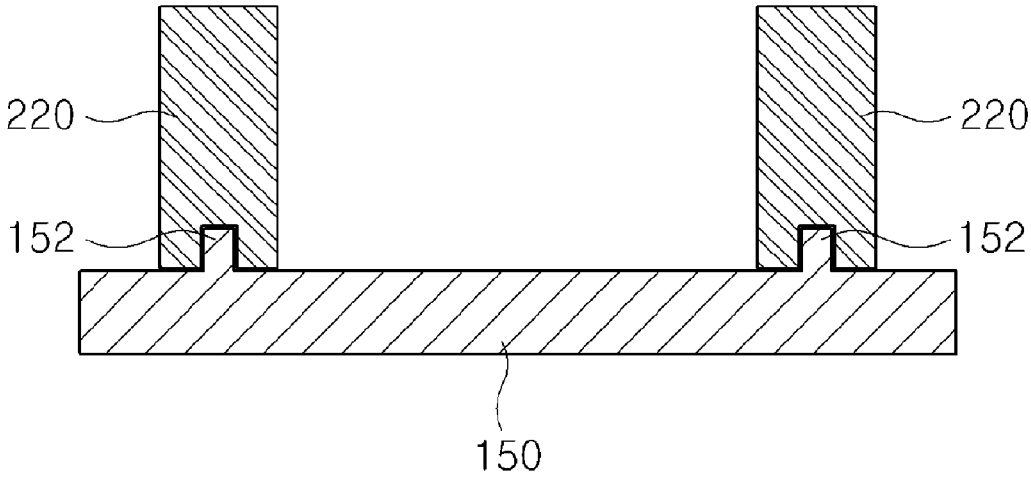
FIG. 6 is a cross-sectional view showing a connection structure of a movable block and the conveyer of the present invention.

Hereinafter, embodiments of the present invention will be described in detail with reference to the accompanying drawings.

An embodiment of a heating furnace for press hardening process according to the present invention is described with reference to FIGS. 2 to 6.

An embodiment of the present invention includes: a cylindrical furnace body 100 that has an inlet at an upper portion through which a steel sheet blank S is inserted from a wound coil C, an outlet at a lower portion through which the steel sheet blank S is discharged, and a space therein for conveying the steel sheet blank S; a conveyer 150 that is spirally arranged on the inner circumference of the furnace body 100 and continuously conveys the steel sheet blank S from the inlet at the upper portion to the outlet at the lower portion; and a clamping means 200 that is disposed at one side of the conveyer 150 and selectively clamps the steel sheet blank S.

In more detail, the furnace body 100 has a cylindrical inner circumference and has a plurality of fire holes 130 to heat the steel sheet blank S.

The conveyer 150 has driving and driven sprockets 132, 134 which can be rotated by the torque of a motor (not shown) at both sides on the inner circumference of the furnace body 100. The driving sprocket 212 is positioned at the upper portion of one side of the furnace body 100 and the driven sprocket 214 is positioned at the lower portion of the other side of the furnace body 100, and they generates movement of a conveyer track.

The fire holes 130 are formed on the inner wall of the furnace body 100 and guides heat from a burner (not shown) into the furnace body 100 to heat the steel sheet blank S.

Figure 8:
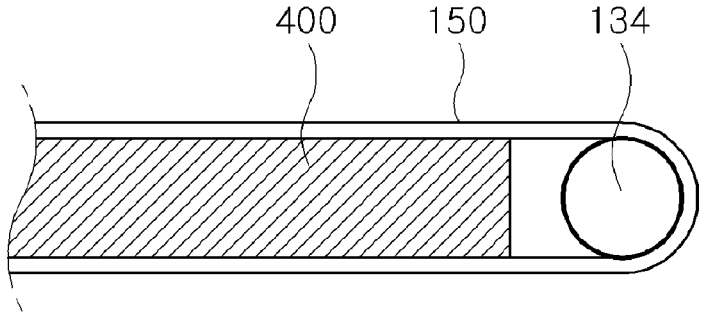
FIG. 8 is a view showing when the conveyer of the present invention is filled with a heating-accumulating member.

In addition to the fire holes 130, preferably, as shown in FIG. 8, a heat-accumulating member 400, other than the fire holes 130, is filled to heat the conveyer 150, as a sub-heating means.

In this structure, it is preferable to have an enclosing structure to fill the conveyer 150 with the heat-accumulating member 400.

The heat-accumulating member 400 accumulates heat from the fire holes 130 and disperses the heat to the conveyer 150 to heat the steel sheet blank S supported by the conveyer 150. The heat-accumulating member 400 functions as a sub-heating means, and may be made of well-known materials, but the material is not limitative and fluid or solid may be used.

Therefore, the heat-accumulating member 400 has a function of accumulating the heat transmitted from the fire holes 130 and transmitting the heat to the conveyer 150 to uniformly heat the portions of the steel sheet blank S which are supported by the clamping means 200.

Further, in the conveyer 150 spirally disposed along the inner circumference of the furnace body 100 to convey the steel sheet blank S down from the top, it is preferable to adjust the angle θ1 or θ2 of the spiral structure in consideration the insert and exit speed of the steel sheet blank S and the heating time.

The clamping means 200 includes a triangular fixed block 210 fixed to one side of the conveyer 150, and a movable block 220 spaced apart from the fixed block 210 to correspond to the fixed block 210 and moved forward/backward by moving means to clamp the steel sheet blank S.

Further, the clamping means 200 includes conveying rollers 230 that partially protrude from the fixed block 210 and the movable block 220 and are rotated by driving force of the motor.

The moving means includes a fixed rail 152 that is located on the top of the conveyer 150 where the movable block is disposed and is aligned in the direction of the conveyer 150 which is the same direction of the movement of the movable block 220, and an actuator 250 that has a rod 255 connected to one side of the movable block seated on the fixed rail 152 and moves the rod 255 forward/backward in response to an external signal.

It is preferable that the actuator 250 has a pneumatic cylinder selectively moving the rod 255 forward/backward, using air pressure supplied from the outside, or a motor moving the rod 255 forward/backward in response to an electric signal from the outside.

Alternatively, an inserting assembly 500 that inserts the steel sheet blank S into the furnace body 100 through the inlet is provided, which includes a base 520 disposed close to the inlet of the furnace body 100 and a plurality of inserting rollers 510 that are spaced at the left and right sides on the base 520 to contact and convey the steel sheet blank S while rotating in opposite directions.

Figure 7:
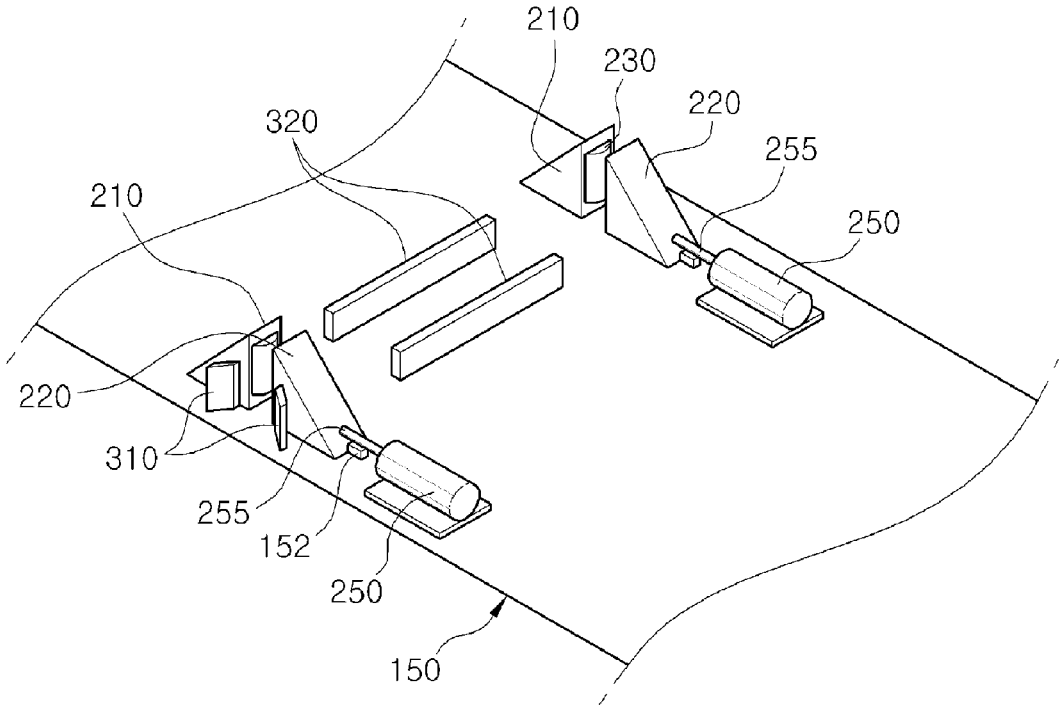
FIG. 7 is a view showing a guide member that guides a steel sheet blank into the furnace body.

More preferably, as shown in FIG. 7, guide members 310 and 320 that are disposed at one side on the conveyer 150 are further included to guide the steel sheet blank S to the clamping means 200.

Further, a controller (not shown) is further included to control an external signal for selecting the forward/backward movement of the movable block 220, and for example, may include a sensor that senses insertion and exit positions of the steel sheet blank S and a typical P.L.C controlling the operation of the movable block 220 in response to a signal from the sensor.

The operation of the present invention having this configuration is described hereafter.

In the heating furnace for press hardening process according to an embodiment of the present invention, as the steel sheet blank S from the wound coil C is inserted into the furnace body 100 through the inlet at the upper portion of the furnace body 100 by using the inserting assembly 500. Then, the steel sheet blank S is clamped by the fixed block 210 and the movable block 220 to be vertically seated and conveyed by the conveyer 150. Finally, the steel sheet is conveyed to the outlet at the lower portion of the furnace body 100 by movement of the conveyer 150.

In this operation, when the steel sheet blank S is moved onto the conveyer 150 through the inlet, it is guided in place by the guide members 310 and 320 to be vertically interposed between the fixed block 210 and the movable block 220. The movable block is pushed to the fixed block 210 by the rod 255 of the actuator 250 and clamps the steel blank S.

Thereafter, the clamped steel sheet blank S is conveyed while the conveyer 150 is circulated, and the movable block 220 moves backward to release the steel sheet blank S, and the steel sheet blank S contacting the conveying roller 230 are conveyed to the outlet by rotating the rollers.

In this structure, the inside of the furnace body 100 and the steel sheet blank S that is conveyed therein are heated by the heat transmitted from the furnace burner through the fire holes 130 in the inner wall of the furnace body 100 while the steel sheet blank S is conveyed on the spiral conveyer 150 downward from the top.

Meanwhile, the conveyer 150 is provided with a sub-heating means, such as the heat-accumulating member 400 as described above. The heat-accumulating member 400 accumulates heat transmitted from the outside and continuously supplies the heat to the conveyer 150 such that the clamped portion of the steel sheet blank S is indirectly heated.

Further, the steel sheet blank S conveyed to the conveying means 200 at the lowermost portion is discharged out of the furnace body 100 through the outlet, and then supplied to a press by a robot, which is the same as in the related art.

Figure 9:
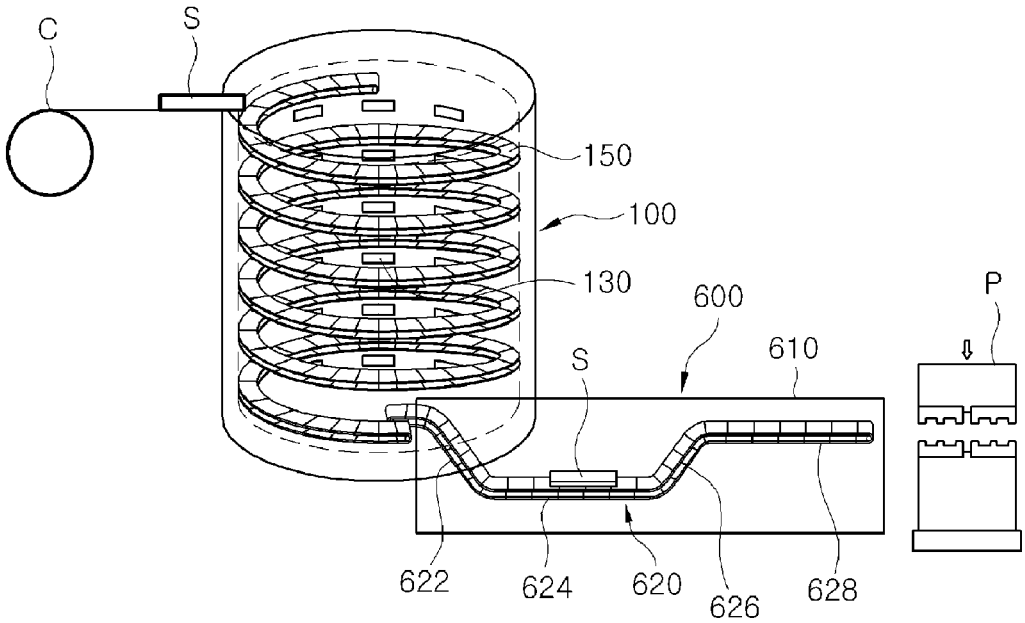
FIG. 9 is a view schematically showing the configuration of a second embodiment of a heating furnace for press hardening process of the present invention.
Figure 10:
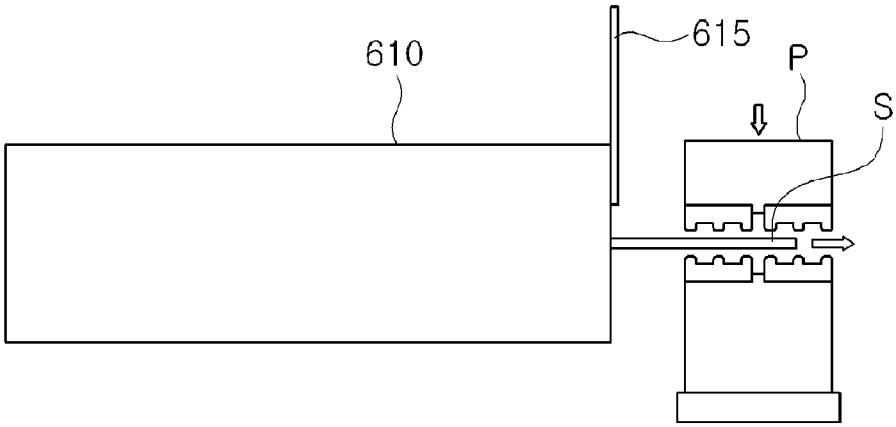
FIG. 10 is a front view showing a discharging means.

FIGS. 9 and 10 are views showing another embodiment of the present invention, in which although the components described above are included, the steel sheet blank is supplied to the press P not by the robot, but there is provided a discharging means 600 that is installed at the outlet of the furnace body 100 to supply the steel sheet blank S discharged out of the furnace body 100 to the press P while shielding the steel sheet blank S from the external air.

The discharging means 600 includes a frame 610 having one side connected to the outlet of the furnace body 100 and the other side equipped with a door 615, and a discharging conveyer 620 that is disposed inside the frame 610 and conveys the steel sheet blank S transported from the conveyer, to the press P.

The door 615 is closed down in a normal state and moves upward to open the other end of the frame 610, when the steel sheet blank S is discharged to the press P.

The door 615 is operated by a typical (hydraulic or pneumatic) cylinder or driving force of a motor.

The frame 610 is integrally connected to a side of the lower portion of the furnace body 100 such that one end communicates with the outlet of the furnace body 100.

The discharging conveyer 620 includes an inserting conveyer part 622 that is disposed in parallel with and close to the end of the conveyer 150 in the furnace body 100, a transporting conveyer part 624 that is connected with the inserting conveyer 622 and horizontally conveys the steel sheet blank S, an inclined conveyer part 626 that is connected with the transporting conveyer 624 and conveys the steel sheet blank S to the insertion height of the press P, and a discharging conveyer part 628 that is connected to an end of the inclined conveyer 626 at a level same with the insertion portion of the press P.

That is, the re-heated steel sheet blank S is shielded from the external air by conveying the steel sheet blank between the spiral conveyer in the furnace body 100 and the press P through the sealed frame 610 by using the discharging conveyer 620.

In this operation, the steel sheet blank S vertically seated by the clamping means and conveyed on the conveyer 150 is moved by the conveying rollers 230 to the inserting conveyer 622 of the discharging conveyer 620 from the end of the conveyer 150, and then falls down by its own weight and is conveyed to the press P.

Though not shown in the figures, the discharging conveyer 620 may be provided with common guides that are disposed at both sides of the discharging conveyer 620 and guide the steel sheet blank, which is laid down by its own weight and conveyed toward the press to the insertion position.

The other components are the same as in the above embodiments and a repeated description is not provided.

Figure 11:
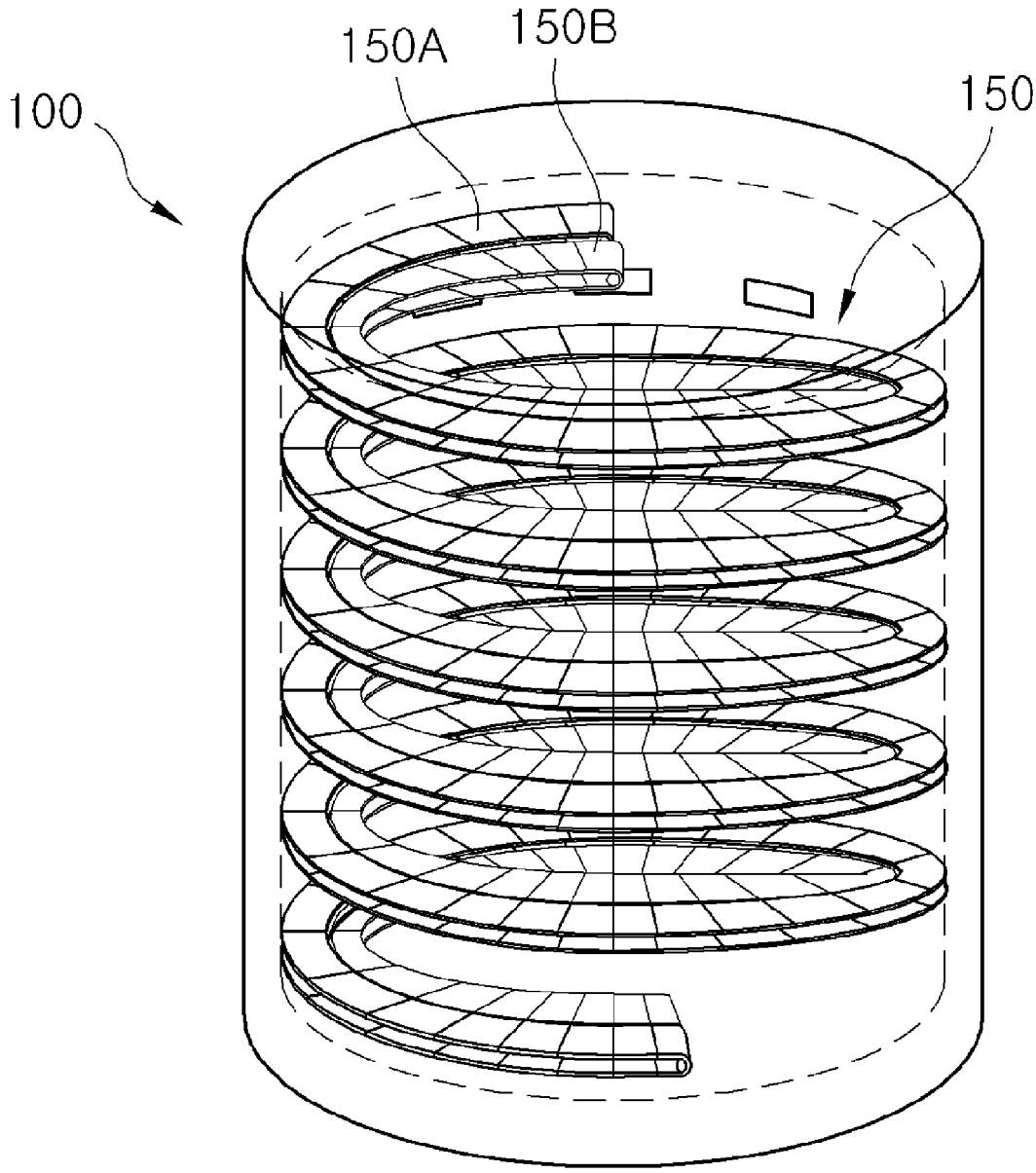
FIG. 11 is a view showing the configuration of a third embodiment of the present invention.
Figure 12:
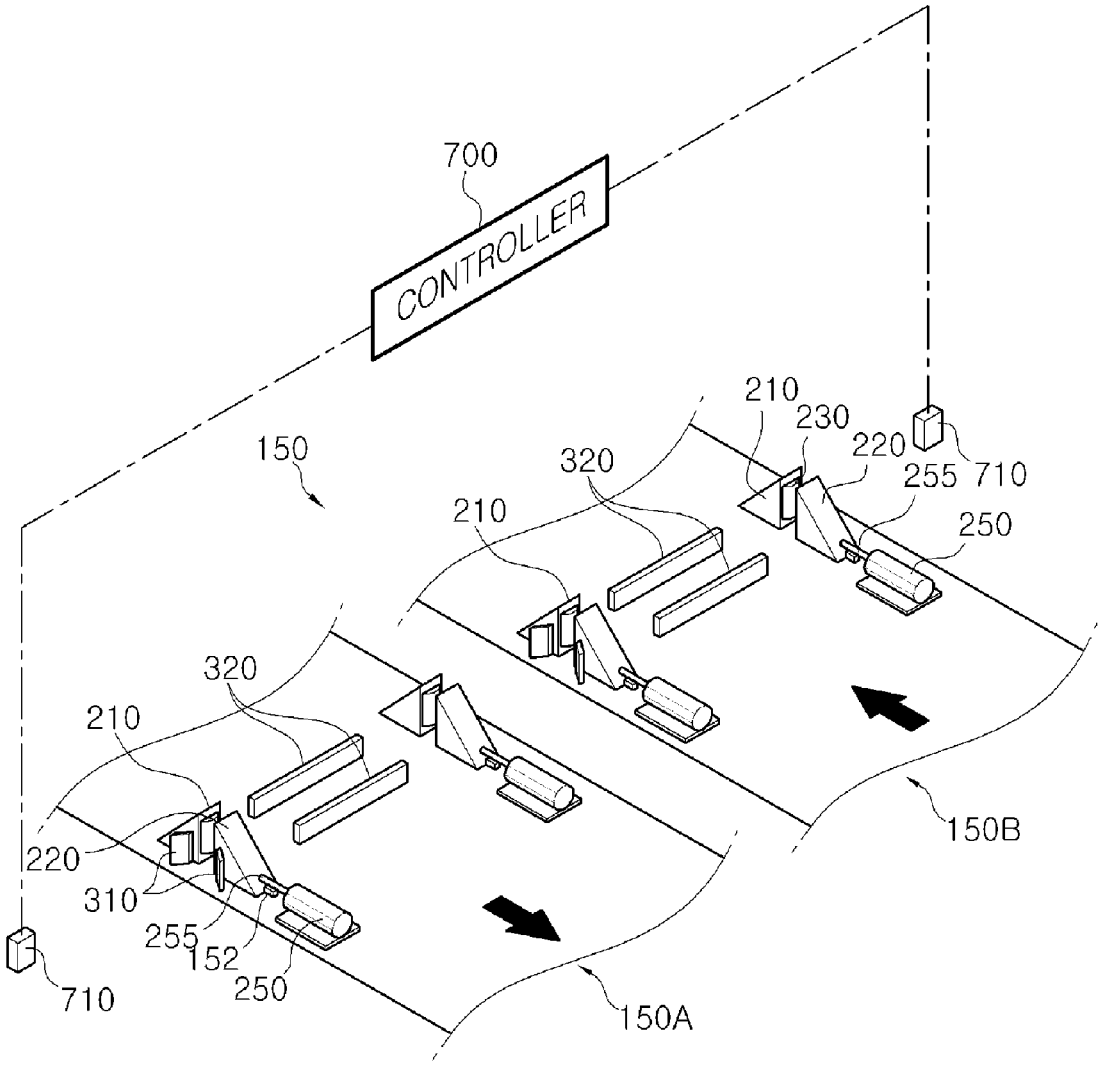
FIG. 12 is a view schematically showing the configuration of a moving means for a steel sheet blank of the third embodiment of the present invention.

FIGS. 11 and 12 are views showing a third embodiment of the present invention, in which the configuration is substantially the same as the embodiments described above, but the conveyer 150 includes an inner conveyer 150A and an outer conveyer 150B that are arranged in a plurality of lines and have different orbits.

In detail, the furnace body 100 has an inlet at one side of the lower portion through which the steel sheet blank S is inserted and an outlet at the other side of the lower portion.

According to this structure, the steel sheet blank S is moved on the outer conveyer 150B from the outside through the inlet located at the lower portion of the furnace body 100, vertically stood by the clamping means and heated while being conveyed to the upper portion in the furnace body 100, and then moved to the clamping means on the inner conveyer 150A by the conveying rollers 230.

The change of path from the outer conveyer 150B to the inner conveyer 15A is made when the inner and outer conveyers 150A, 150B stopped.

The inner and outer conveyers 150A, 150B may have the fixed block 210 and the movable block 220, which are described in the above embodiments, for the clamping means, and accordingly, the operation is the same and the repeated description is not provided.

The steel sheet blank S is moved from the outer conveyer 150B to the inner conveyer 150A by aligning fixed blocks 210 of the clamping means in the inner conveyer 150A and the outer conveyer 150B and then rotating the conveying rollers 230.

A sensing means is needed to sense the alignment of the clamping means of the inner conveyer 150A and the outer conveyer 150B.

The sensing means further includes a position sensor 710 that senses whether the clamping means of the inner conveyer 150A and the outer conveyer 150B are aligned and outputs an electric signal, and a controller 700 that outputs a control signal for conveying the steel sheet blank S to the clamping means, after determining that the clamping means of the inner conveyer 150A and the outer conveyer 150B are aligned, in response to a signal from the position sensor 710.

Figure 13:
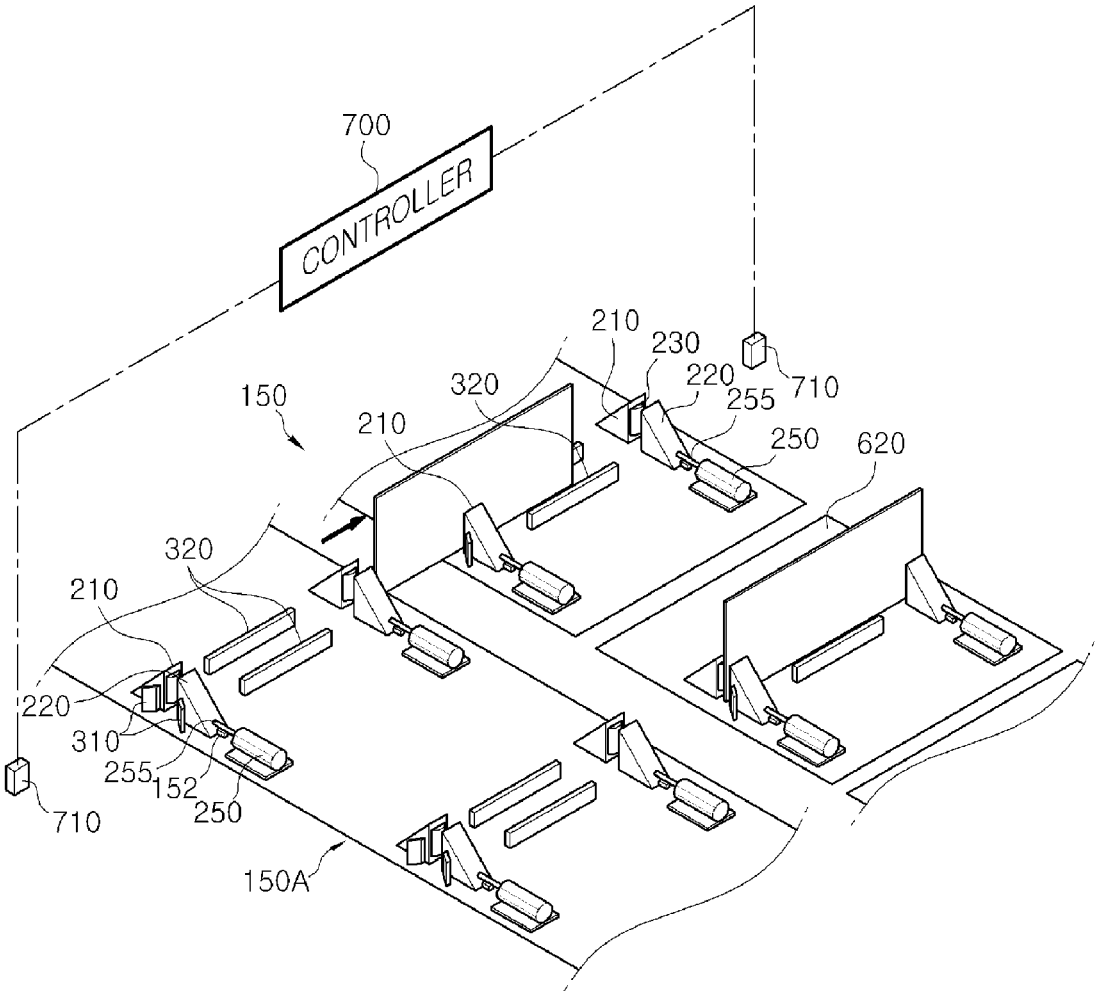
FIG. 13 is a view showing the configuration of a fourth embodiment of the present invention.
Figure 14:
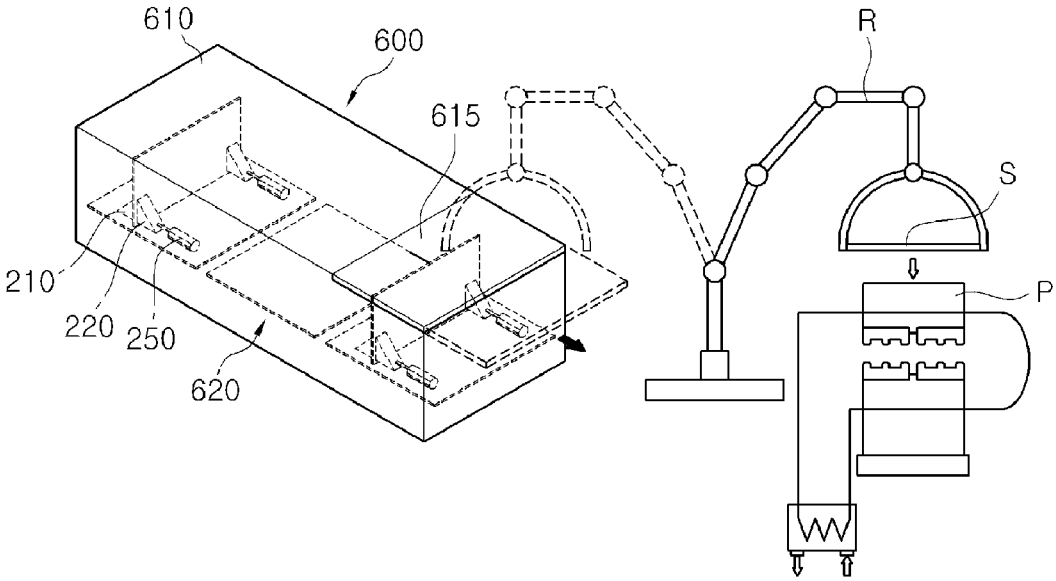
FIG. 14 is a view showing the operation of a discharging means of the fourth embodiment of the present invention.

FIGS. 13 and 14 are views showing a fourth embodiment of the present invention, in which the discharging means has a different structure. The discharging means has partially the same configuration, including the frame of the second embodiment; however, the discharging conveyer 620 that horizontally moves the steel sheet blank S is provided with a clamping means and the frame 610 has a door 615 that is horizontally opened/closed, at the upper portion of the opposite side.

Further, a robot R is disposed between the frame 610 and the press P.

The robot R holds the steel sheet blank S vertically stood by the clamping means and supplies it to the press P, when the door 615 is opened.

The steel sheet blank S is moved from the inner conveyer 150A in the furnace body 100 to the clamping means of the discharging conveyer 620 by a moving means.

The moving means has the same components as in the embodiments described above, that is, those for movement between the inner and outer conveyers, including the position sensor 710, controller 700, and the conveying rollers 230 of the clamping means, therefore, they are given the same reference numerals.

What is claimed is:

1. A heating furnace for press hardening process, comprising:

a furnace body comprising a plurality of fire holes, and an inlet and an outlet located at an upper portion and a lower portion, respectively;

a conveyer having a spiral shaped configuration, disposed inside the furnace body, and configured to circulate by track circulation; and a clamp device attached to the conveyer and configured to clamp and convey a steel sheet blank, wherein the clamp device comprises:

a fixed block fixed to the conveyer, a movable block spaced from the fixed block, corresponding to the fixed block and movable forward/backward to clamp the steel sheet blank by a moving unit, and conveying rollers installed to the fixed block and the movable block and rotatable by driving force of a motor.

2. The heating furnace for press hardening process according to claim 1, wherein the moving unit includes:

a fixed rail protruding from the conveyer, wherein the movable block is slidably seated on the fixed rail; and an actuator connected to the movable block seated on the fixed rail and configured to move the movable block by moving a rod forward in response to an external signal.

3. The heating furnace for press hardening process according to claim 2, wherein the actuator comprises a pneumatic cylinder.

4. The heating furnace for press hardening process according to claim 2, wherein the actuator comprises a motor configured to move the rod forward/backward in response to the external electric signal.

5. The heating furnace for press hardening process according to claim 1, further comprising a guide disposed on the conveyer and configured to guide the steel sheet blank to the clamp device.

6. The heating furnace for press hardening process according to claim 1, further comprising a heat-accumulating member disposed close to the conveyer and configured to accumulate heat transmitted through the fire holes.

7. The heating furnace for press hardening process according to claim 1, further comprising a discharge apparatus disposed at the outlet of the furnace body and configured to transfer the steel sheet blank discharged from the furnace body to a press, and configured to shield the steel sheet blank from external air.

8. The heating furnace for press hardening process according to claim 7, wherein the discharge apparatus includes:

a frame having one end connected to the outlet of the furnace body and the other end equipped with a door; and a discharging conveyer disposed inside the frame and configured to convey the steel sheet blank transported from the conveyer to the press.

9. The heating furnace for press hardening process according to claim 8, wherein the discharging conveyer includes:

a transporting conveyer part disposed close to the outlet of the furnace body and configured to horizontally convey the steel sheet blank; and an inclined conveyer part connected with the transporting conveyer part and configured to convey the steel sheet blank to an insertion height of the press.

10. A heating furnace for press hardening process, comprising:

a furnace body having an inlet and an outlet;

a conveyer having a spiral shaped configuration, disposed inside the furnace body, and configured to circulate by track circulation;

a clamp device attached to the conveyer and configured to clamp and convey a steel sheet blank;

an inserting device disposed close to the inlet of the furnace body and having a plurality of rotatable conveying rollers to convey the steel sheet blank to the clamp device; and a discharge device disposed close to the outlet of the furnace body and configured to transfer the steel sheet blank discharged out of the furnace body to the press and shield the steel sheet blank from the external air, wherein the clamp device comprises:

a fixed block fixed to the conveyer, a movable block spaced from the fixed block, corresponding to the fixed block and movable forward/backward to clamp the steel sheet blank by a moving unit, and conveying rollers installed to the fixed block and the movable block and rotatable by driving force of a motor.

11. A heating furnace for press hardening process, comprising:

a furnace body that has an inlet and an outlet;

a conveyer having a spiral shaped configuration, disposed inside the furnace body, and configured to circulate by track circulation; and clamp devices attached to the conveyer and configured to clamp and convey a steel sheet blank, wherein at least one of the clamp devices comprises:

a fixed block fixed to the conveyer, a movable block spaced from the fixed block, corresponding to the fixed block and movable forward/backward to clamp the steel sheet blank by a moving unit, and conveying rollers installed to the fixed block and the movable block and rotatable by driving force of a motor.

12. The heating furnace for press hardening process according to claim 11, wherein the conveyer comprises an inner conveyer portion and an outer conveyer portion circulate in opposite directions.

13. The heating furnace for press hardening process according to claim 11, further comprising a discharge device disposed at the outlet of the furnace body and configured to transfer the steel sheet blank discharged out of the furnace body to a press and shield the steel sheet blank from external air.

14. The heating furnace for press hardening process according to claim 13, wherein the discharge device includes:

a frame having one end connected to the outlet of the furnace body and the other end equipped with a door at its upper portion; and a discharging conveyer disposed inside the frame and configured to convey the steel sheet blank transported from the conveyer to the door, maintaining the steel sheet blank upright by using the clamp device; and a robot configured to hold the steel sheet blank conveyed from the discharging conveyer and configured to supply the steel sheet blank to the press.

15. A heating furnace for press hardening process, comprising:

a furnace body that has an inlet and an outlet;

a conveyer having a spiral shaped configuration, disposed inside the furnace body, and configured to circulate by track circulation, wherein the conveyer comprises an inner conveyer portion and an outer conveyer portion circulate in opposite directions;

clamp devices attached to the conveyer and configured to clamp and convey a steel sheet blank;

a position sensor configured to sense whether the clamp devices of the inner conveyer portion and the outer conveyer portion are aligned and configured to output an electric signal; and a controller configured to output a control signal for conveying the steel sheet blank to the clamp device in response to a signal from the position sensor after determining that the clamp devices of the inner conveyer portion and the outer conveyer portion are aligned.

* * * * *